US007401939B2

(12) United States Patent
Haugaard et al.

(10) Patent No.: US 7,401,939 B2
(45) Date of Patent: Jul. 22, 2008

(54) WALL MOUNT WITH DETACHABLE SUPPORT PANEL

(75) Inventors: Eric J. Haugaard, Kenosha, WI (US); Kurt S. Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 230 days.

(21) Appl. No.: 10/966,878

(22) Filed: Oct. 15, 2004

(65) Prior Publication Data

US 2006/0083007 A1 Apr. 20, 2006

(51) Int. Cl.
*F21S 8/00* (2006.01)
*F21S 13/02* (2006.01)

(52) U.S. Cl. ..... 362/147; 362/432; 362/285

(58) Field of Classification Search ..... 362/147, 362/432, 285, 287, 288
See application file for complete search history.

(56) References Cited

U.S. PATENT DOCUMENTS 4,156,272 A 5/1979 Wandler
4,199,803 A * 4/1980 Hunt, III ..... 362/263
4,222,093 A * 9/1980 Garcia et al. ..... 362/147
4,368,506 A * 1/1983 Rapp ..... 362/147
5,307,254 A * 4/1994 Russello et al. ..... 362/368
5,348,268 A * 9/1994 Klein ..... 248/681
5,376,020 A * 12/1994 Jones ..... 439/537
6,467,928 B2 10/2002 Crelin
6,530,681 B2 * 3/2003 Sieczkowski ..... 362/404
6,734,356 B1 5/2004 Gretz
6,848,806 B2 * 2/2005 Yoshida et al. ..... 362/147
6,905,222 B1 * 6/2005 Russello et al. ..... 362/147
6,945,675 B2 * 9/2005 Jongewaard et al. ..... 362/371
7,108,238 B2 * 9/2006 Gauci ..... 248/221.11
2003/0227772 A1 * 12/2003 Yoshida et al. ..... 362/147

* cited by examiner

*Primary Examiner*—Jacob Y Choi
(74) *Attorney, Agent, or Firm*—Jansson, Shupe & Munger Ltd.

(57) ABSTRACT

An apparatus for mounting a lighting fixture is provided having a mount housing with at least one pivot portion and a support panel with at least one hook portion, the support panel being attached to the mount housing in a manner where the hook portion can slide and pivot with respect to the pivot portion. The pivot portion includes a rail, a tab-slot and a tab-rest, the tab-slot and tab-rest being adjacent to the rail and the hook portion has a hook member and a tab-stand adjacent to the hook member. The support panel is free to move between an open and a closed position and, preferably, detachable from the mount housing. A method for mounting a lighting fixture is also disclosed.

26 Claims, 5 Drawing Sheets

WALL MOUNT WITH DETACHABLE SUPPORT PANEL

FIELD OF THE INVENTION

This invention is related generally to apparatus for mounting lighting fixtures and, more particularly, to apparatus for mounting lighting fixtures having a slidable and pivotable support panel.

BACKGROUND OF THE INVENTION

A wide variety of flood and area lighting fixtures exist to provide illumination of buildings, parking lots, walkways and the like. Such fixtures are frequently mounted high in the air on the walls of buildings where they can only be installed with the assistance of a ladder or aerial lift. Of particular concern, however, is that most lighting fixtures of this type are unwieldy in size, shape and weight, making them extremely difficult to handle when installed. These fixtures also often use mounting brackets that are either unattractive or clash with the appearance of the lighting fixture or its surrounding building.

Installation of a flood or area lighting fixture requires that it first be properly connected electrically to the wiring needed to power the fixture before it is mechanically fastened to the supporting wall mount. Both of these operations can be dangerous, however, when the installation is performed high above the ground from oftentimes only the top of a ladder. Since either operation demands the use of two hands, the installer must find a way to support the fixture upon the ladder near him and yet leave unobstructed the needed workspace. As a result, given the dimensions and weight of the lighting fixture, installation is usually accomplished in a manner contributing undue risk to the worker.

It would be highly desirable therefore to have a mounting apparatus that first fastens the lighting fixture to the apparatus in an easy and efficient manner and afterwards elevates the fixture such that it is above yet adjacent to the workspace needed by the installer for completing the remaining electrical connections. This invention meets these needs and overcomes other problems and shortcomings found in the prior art.

OBJECTS OF THE INVENTION

An object of this invention is to provide an improved apparatus for mounting a lighting fixture that overcomes a number of the problems and shortcomings in the prior art, including those referred to above.

Another object of the invention is to provide a novel apparatus for mounting a lighting fixture that allows the fixture to be mechanically secured to the apparatus in a convenient manner before having to perform any electrical connections to the fixture.

Another object of the invention is to provide an exceptional apparatus for mounting a lighting fixture having a support panel that permits the fixture to be maintained in an elevated position so as to facilitate making electrical connections during installation of the fixture as well as to provide convenient access to such connections afterwards.

Yet another object of the invention is to provide an excellent apparatus for mounting a lighting fixture having a support panel that is detachable from its mount housing to allow for safe and efficient securing of the fixture to the panel and to permit unobstructed access within the housing to the leads of the electrical conduit needed to power the fixture.

Still another object of the invention is to provide a desirable apparatus for mounting a lighting fixture that is simple and inexpensive to construct, highly reliable to use and pleasing in appearance.

SUMMARY OF THE INVENTION

This invention is an improved apparatus for mounting a lighting fixture. The apparatus has a mount housing with at least one pivot portion and a support panel with at least one hook portion, the support panel being attached to the mount housing in a manner where the hook portion can slide and pivot with respect to the pivot portion. The pivot portion includes a rail, a tab-slot and a tab-rest, the tab-slot and tab-rest being adjacent to the rail. The hook portion has a hook member and a tab-stand adjacent to the hook member. The support panel is free to move between an open and a closed position.

In certain desired embodiments, the hook portion is detachably engaged with respect to the pivot portion to allow the support panel to be removed and then reattached to the mount housing. More desirable is where the mount housing has two pivot portions and the support panel has two corresponding hook portions. A highly preferred embodiment finds the pivot portion also having a tab-stop located between the tab-slot and the tab-rest.

Also preferred is where the apparatus includes a front-wall and where the mount housing has two front-wall portions. The front-wall portion define a support-panel cavity that allows the mount housing to fittingly engage the support panel when it is in the closed position so that the front-wall portions and the support panel form the front-wall.

In a most desirable embodiment, the mount housing has at least one entry-site that serves to allow an electrical conduit to be inserted into the apparatus. The term "entry-site" as used herein refers to a structure formed within the apparatus that is adapted to allow an electrical conduit or other electrical wiring to be inserted or otherwise received by the apparatus. Such structures include enclosed apertures, not fully enclosed apertures and knockouts where the aperture is covered with a breakaway wall.

Most desirable is where the mount housing comprises a wall bracket and a housing cover that is removably secured to the wall bracket. Also preferred is where the mount housing has top, rear and side entry-sites. A wall bracket that has attachment-slots so that the mount housing can be secured to a junction box is highly desirable.

Another aspect of this invention provides an apparatus for mounting a lighting fixture that includes a wall bracket with at least one entry-site adapted to receive an electrical conduit, a housing cover that can be secured to but later taken off the wall bracket, the housing cover having a cover-site that is aligned with the entry-site, and a support panel that is slidably and pivotally engaged to the housing cover. Preferably, the wall bracket has attachment-slots to allow the apparatus to be secured to a junction box.

In this aspect of the invention, a desirable embodiment is where the housing cover has two front-wall portions that together define a support-panel cavity. The cavity is sized to fittingly receive the support panel such that in the closed position, the support panel and the front-wall portions complete a front-wall to the apparatus.

More preferred is where the housing cover has a pivot portion and the support panel has a hook portion. The pivot portion includes a rail along with a tab-slot and a tab-rest adjacent to the rail. The hook portion includes a hook member and a tab-stand adjacent to the hook member. Moreover, the hook portion is slidably and pivotally engaged to the pivot portion. In a most desirable embodiment, the hook portion is also detachable from the pivot portion on which it slides and pivots.

In another aspect of this invention, a method is provided for mounting a lighting fixture to a selected surface. This method includes the steps of (1) providing a mounting apparatus having a mount housing and a support panel slidably and pivotally engaged to the mount housing that allows the support panel to freely move between open and closed positions; (2) attaching the mount housing to the selected surface at a desired position; (3) inserting electrical wiring into the mount housing; (4) securing the lighting fixture to the support panel; (5) moving the support panel to its open position; (6) connecting the electrical wiring to the lighting fixture; and (7) moving the support panel to the closed position.

Certain embodiments of this method find the support panel to be detachable from the mount housing and adding the steps of detaching the support panel from the mount housing and of attaching the support panel to the mount housing after securing the lighting fixture to the panel.

Most desirable is where the mount housing includes two pivot portions, each having a rail, a tab-slot and a tab-rest, and the support panel includes hook portions, each having a hook member and a tab-stand. Each hook portion is furthermore slidably and pivotally engaged with respect to a corresponding pivot portion.

In a preferred embodiment of this method, the mount housing includes a wall bracket and a housing cover removably secured to the wall bracket. More preferred is where the mount housing has top, rear and side entry-sites through which an electrical conduit can be inserted. Highly preferred finds the desired position to be adjacent to a junction box.

Another aspect of this invention is directed to an apparatus for mounting a lighting fixture that has a mount housing and a support panel secured with respect to the lighting fixture. The mount housing includes a pivot portion and the support panel a hook portion, the hook portion being slidably and pivotally engaged with respect to the pivot portion. Preferably, the pivot portion comprises a rail, a tab-slot and a tab-rest, the tab-slot and tab-rest being adjacent to the rail, and the hook portion comprises a hook member and a tab-stand adjacent to the hook member.

In certain select embodiments, the apparatus also has a front-wall such that the two front-wall portions of the mount housing and the support panel complete the front-wall. Highly desirable is where the hook portion of the support panel is detachably engaged with the pivot portion of the mount housing.

DETAILED DESCRIPTION OF PREFERRED EMBODIMENTS

Figure 1:
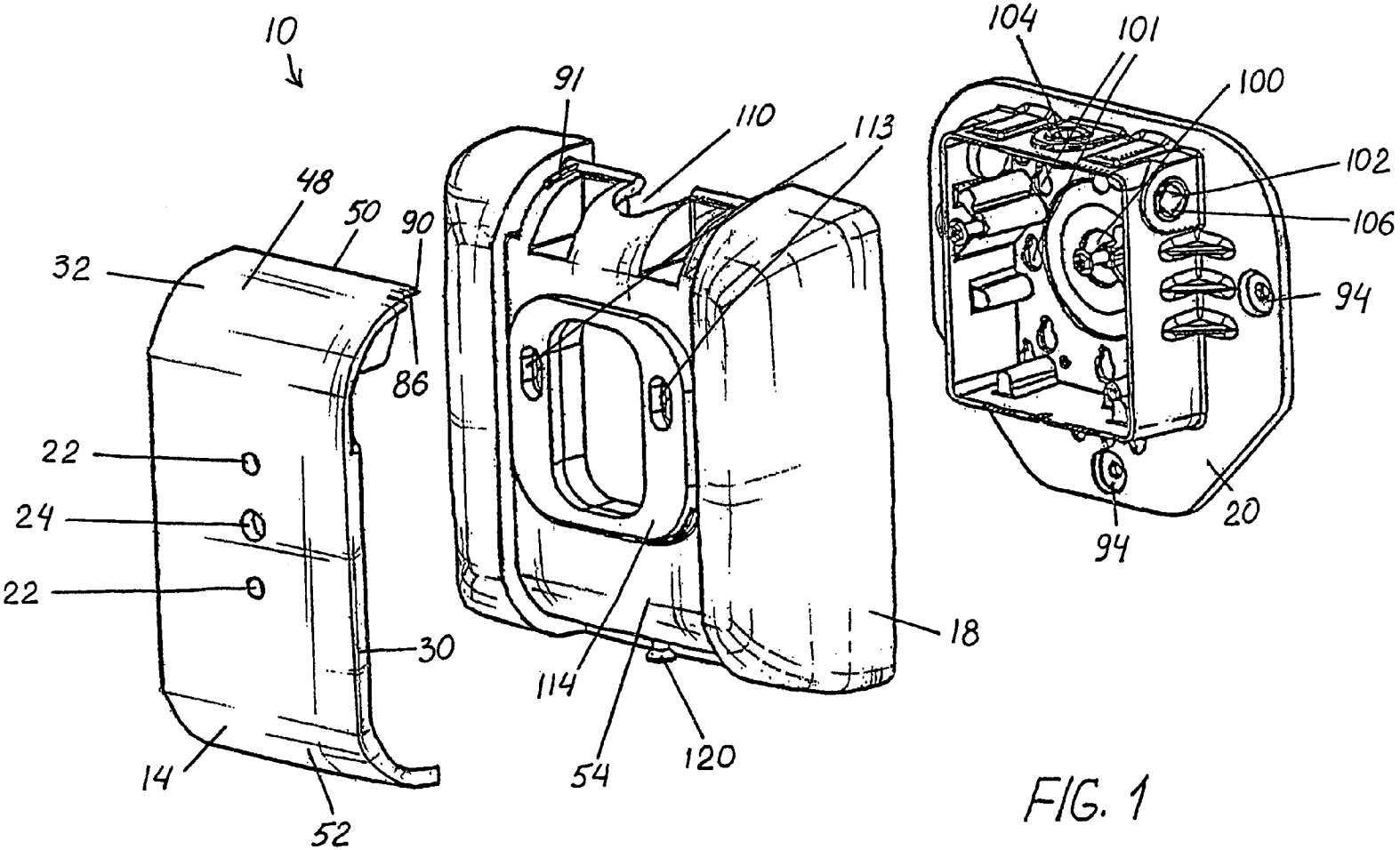
FIG. 1 is an exploded view of a preferred apparatus for mounting a lighting fixture in accordance with this invention.

The drawings illustrate an improved apparatus 10 for mounting a lighting fixture 12 in accordance with this invention. Apparatus 10 includes support panel 14 and mount housing 16. As seen in the preferred embodiment shown in FIG. 1, mount housing 16 has housing cover 18 and wall bracket 20.

Figure 2:
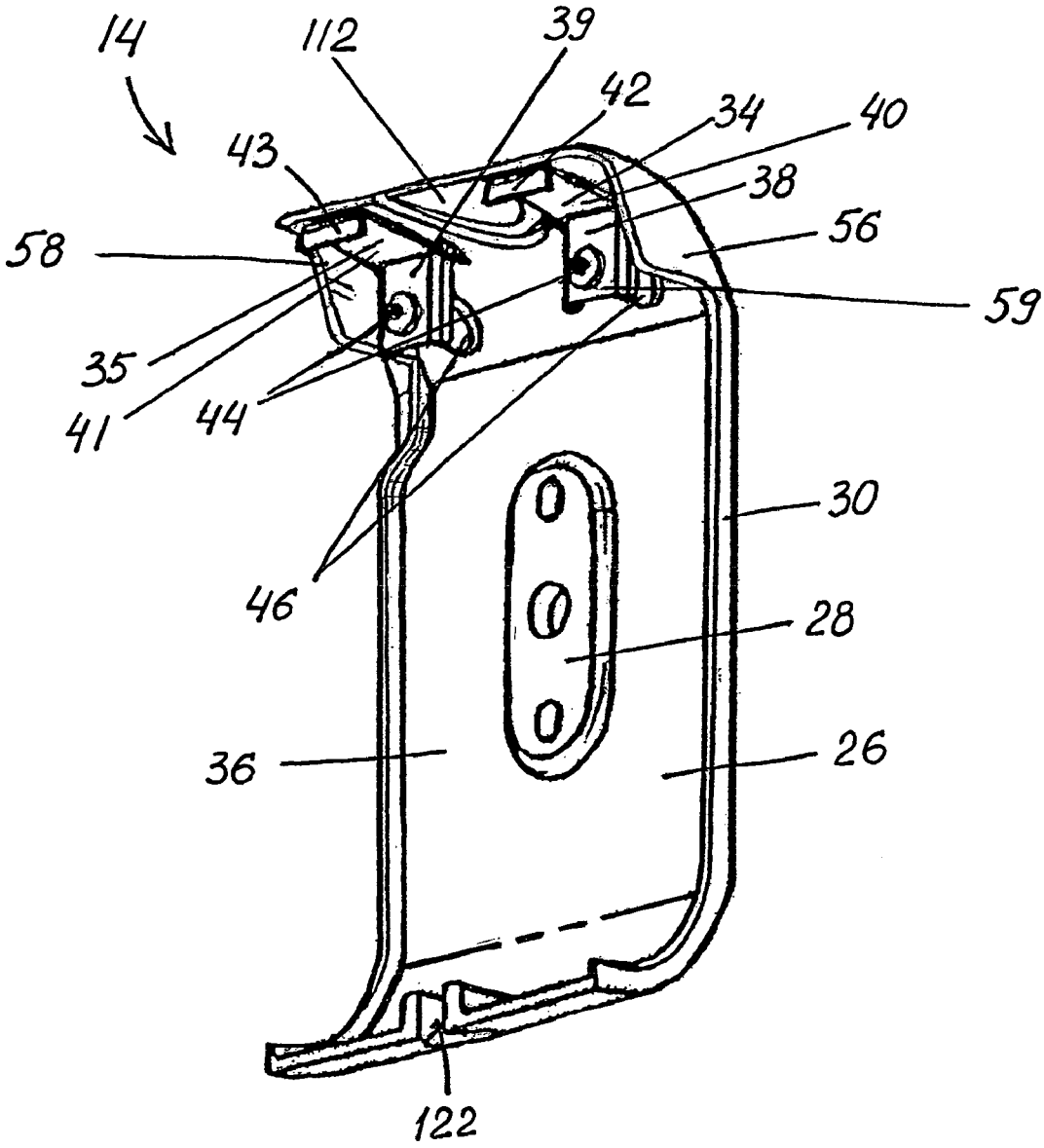
FIG. 2 is a rear view of a preferred support panel of the apparatus of FIG. 1.

Support panel 14 is provided with two support apertures 22 and wiring aperture 24. When mounted, lighting fixture 12 is rigidly secured to support panel 14 by having two fasteners (not shown) received in each support aperture 22 from the rear wall of lighting fixture 12. The fasteners are preferably ⅝ inch bolts having a diameter appropriate for the size and weight of the fixture being mounted. As illustrated in FIG. 2, rear surface 26 of support panel 14 has reinforced portion 28 surrounding apertures 22, 24, adding depth to panel wall 30, to insure a firm engagement between fixture 12 and front surface 32 when securing the bolts in place with corresponding nuts (not shown).

As seen in FIG. 2, support panel 14 includes two hook members 34, 35 mounted to panel base 36. Each hook member 34, 35 is preferably a single piece of sheet metal of sufficient gauge to provide structural integrity but still allow hook members 34, 35 to receive two bends so as to form mounting portions 38, 39, middle portions 40, 41 and hooks 42, 43. Hook fastener 44 is received by mounting boss 46 to secure mounting portions 38, 39 to panel base 36. Middle portions 40, 41 extend rearward from mounting portions 38, 39 and upward at an angle corresponding to the curve of upper end 48. The distal end of each mounting portion 38, 39 is adjacent to upper edge 50 of panel base 36. Hooks 42, 43 extend downward from the distal end of the corresponding middle portion 40, 41 and are parallel with the corresponding mounting portion 38, 39. Panel base 36 is preferably fabricated from a strong lightweight metal such as die-cast aluminum. Upper and lower ends 48, 52 of panel base 36 curve rearward to permit support panel 14 to fittingly engage the arcuately curved front surface 54 of housing cover 18.

Upper end 48 of panel base 36 forms first and second tab-stands 56, 58 at both ends of upper edge 50. Tab-stands 56, 58 are parallel with each other and orthogonal to upper edge 50. Tab-stands 56, 58 together with hook members 34, 35 comprise hook portion 59 of support panel 14.

Figure 3B:
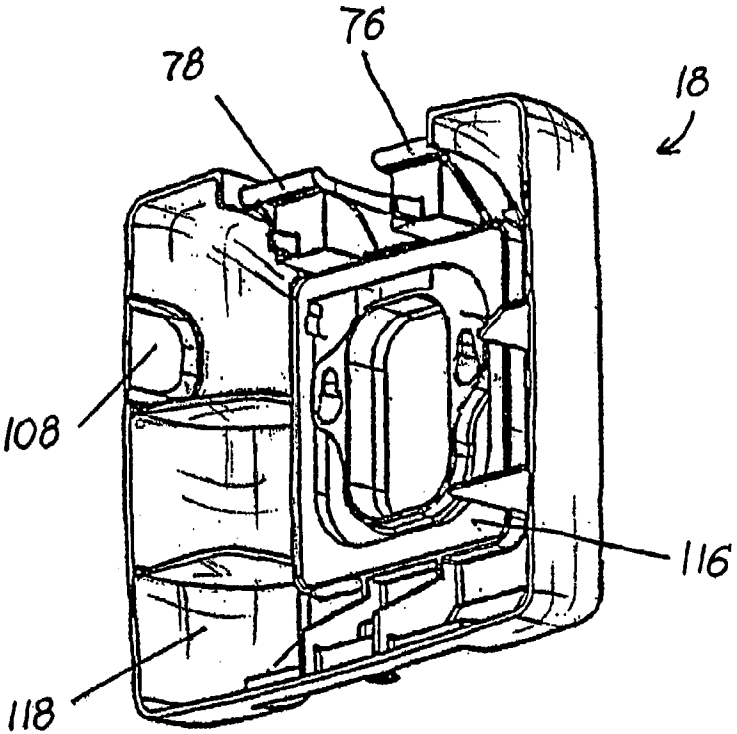
FIG. 3B is a rear view of the housing cover of FIG. 3A.
Figure 3A:
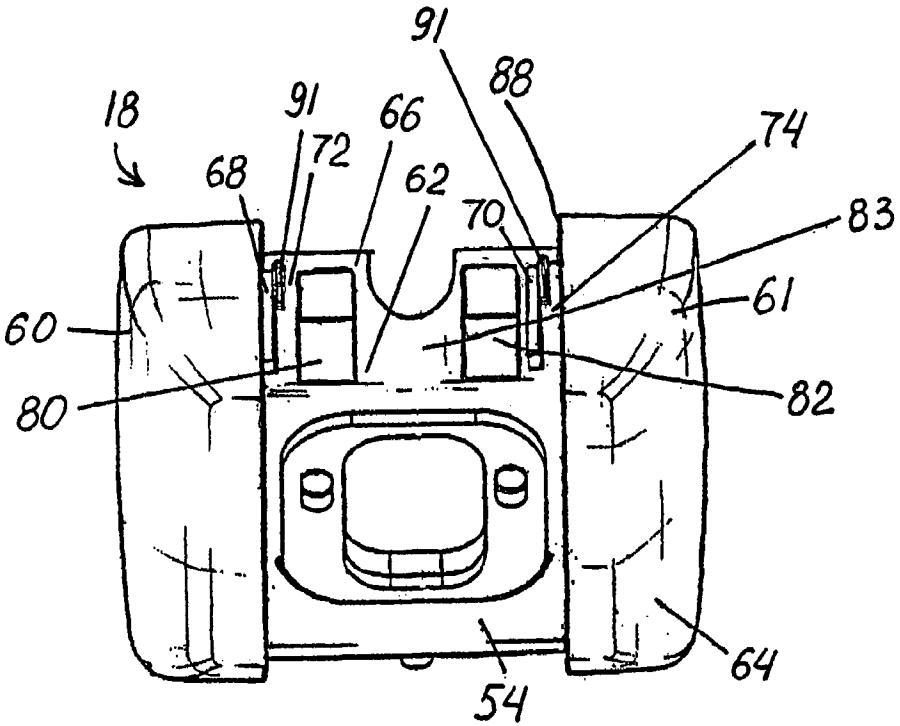
FIG. 3A is a front view of a preferred housing cover of the apparatus of FIG. 1.

Housing cover 18 is also preferably fabricated from die-cast aluminum. As shown in FIG. 3, housing cover 18 forms first and second front-wall portions 60, 61 on either side of support-panel cavity 62. Support-panel cavity 62 is recessed below the outer surface 64 of front-wall portion 60, 61. Top end 66 of support-panel cavity 62 forms first and second tab-slots 68, 70; first and second tab-rests 72, 74; first and second rails 76, 78; and first and second receptacle spaces 80, 82. Tab-slots 68, 70, tab-rests 72, 74, and rails 76, 78 comprise pivot portion 83 of mount housing 16.

In attaching support panel 14 to housing cover 18, hooks 42, 43 are placed behind corresponding rail 76, 78. Hook members 34, 35 engage rails 76, 78 in a manner that allows hook members 34, 35 and thereby support panel 14 to slide laterally and pivot upward upon housing cover 18. When attached, hooks 42, 43 serve as stops that prevents support panel 14 from slipping off rails 76, 78. Support panel 14 can, however, be easily detached from housing cover 18 by lifting support panel 14 upward until hooks 42, 43 are clear of rails 76, 78.

Figure 4:
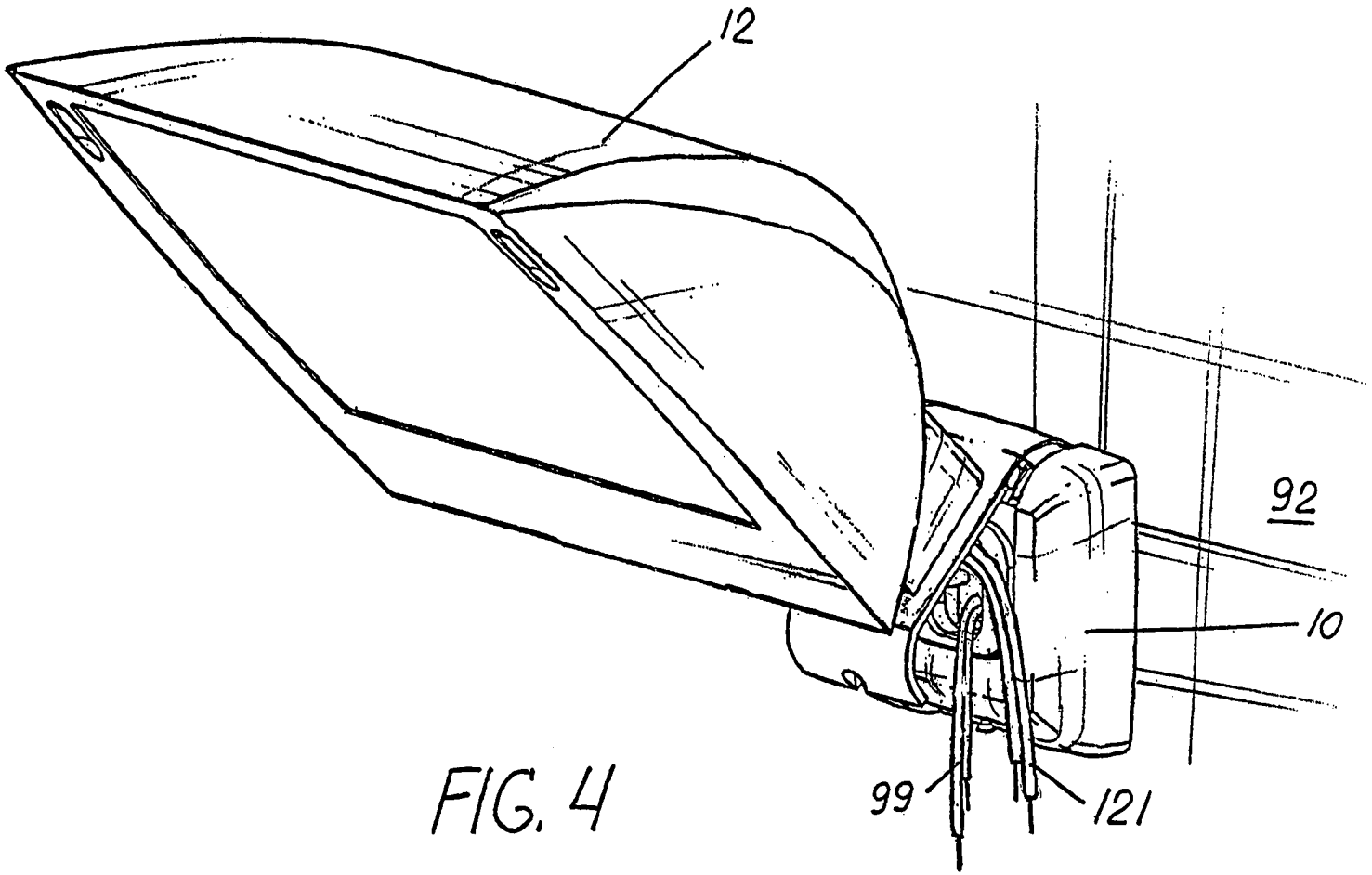
FIG. 4 is a perspective view of the apparatus in the open position with an attached lighting fixture.
Figure 5:
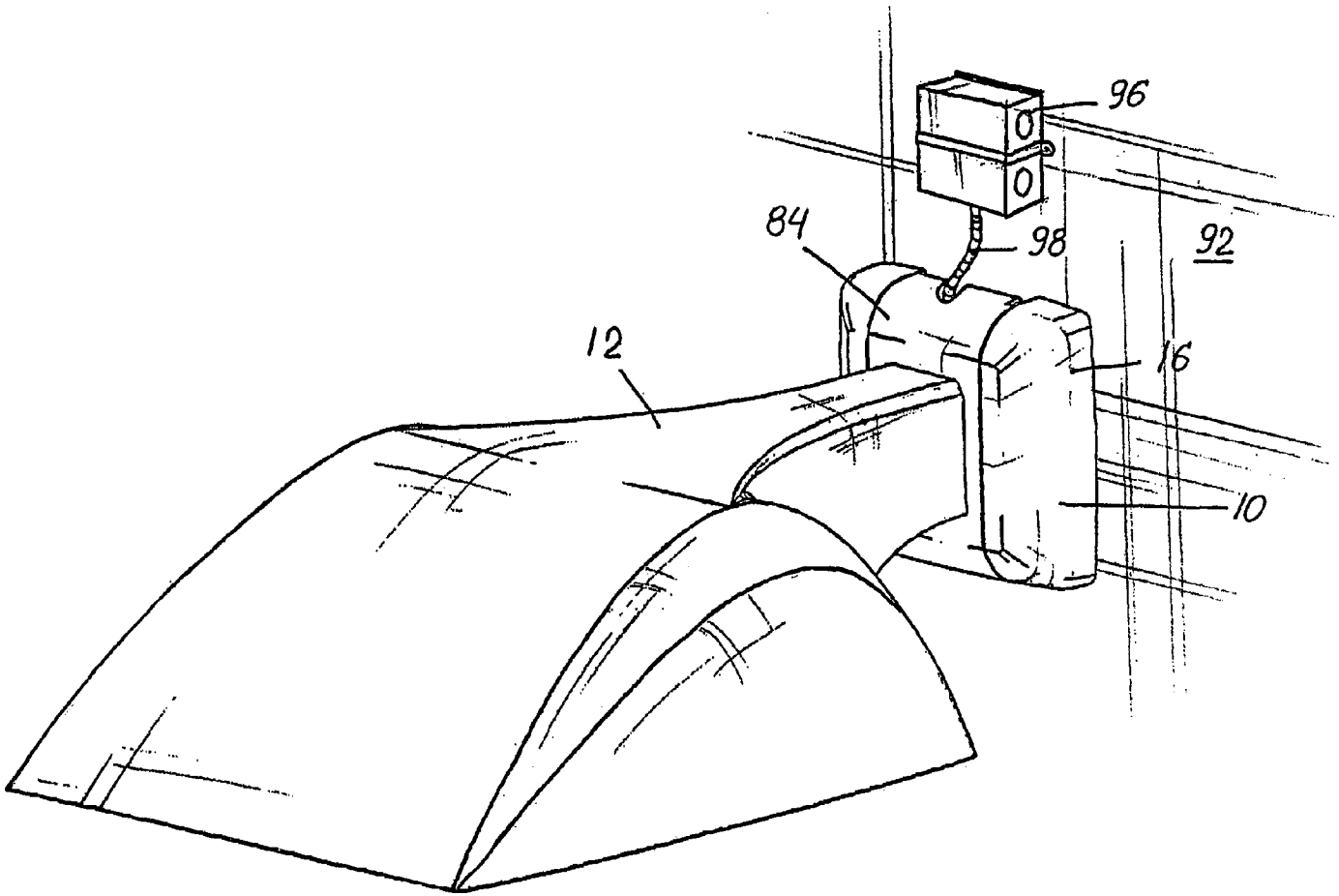
FIG. 5 is a perspective view of the apparatus in the closed position with an attached lighting fixture.

When attached to housing cover 18, support panel 14 can be moved to either an open or closed position as illustrated in FIGS. 4-5. Support panel 14 is placed in the closed position by sliding it along rails 76, 78 to where first and second tab-stands 56, 58 align with first and second tab-slots 68, 70 respectively. Tab-stands 56, 58 are received by tab-slots 68, 70 and hook members 34, 35 are received by the corresponding receptacle space 80, 82 to place support panel 14 in fitted engagement within support-panel cavity 62. In the closed position, front surface 32 of support panel 14 form with outer surface 64 of front-wall portions 60, 61 a contiguous front-wall 84 for housing cover 18.

Support panel 14 is placed in the open position from the closed position by pivoting support panel 14 upward until tab-stands 56, 58 clear tab-slots 68, 70. Support panel 14 can then be slide laterally along rails 76, 78 until tab-stands 56, 58 are in alignment with corresponding tab-rests 72, 74. One can readily see that tab-stands 56, 58 allow support panel 14 to be supported in an elevated, open position by abutting and resting upon tab-rests 72, 74.

Panel notch 86 in upper edge 50 of support panel 14 serves to limit lateral movement of support panel 14 by allowing support panel 14 to slide past the sidewall 88 of second front-wall portion 61 until stopped by notch edge 90. Panel notch 86 prevents support panel 14 from being slid inadvertently to a position where tab-stands 56, 57 could drop into receptacle spaces 80, 82. Tab-stops 91 are situated between each tab-slot 68, 70 and tab-rests 72, 74 to likewise prevent support panel 14 from inadvertently sliding towards first front-wall portion 60 while in the open position such that tab-stands 56, 57 drop into tab-slots 68, 70. Support panel 14 must be pivoted back and slid over tab-stops 91 for support panel 14 to be returned to its closed position.

In mounting fixture 12 to a selected surface such as a wall 92 as shown in FIGS. 4-5, wall bracket 20 is mounted to wall 92 using the appropriate fasteners for the surface and location, fasteners being received by bracket apertures 94. Wall bracket 20 is preferably placed adjacent to a junction box 96. Electrical conduit 98 can be inserted into wall bracket 20 directly as seen in FIG. 5 or electrical leads 99 from a junction box recessed in the wall as seen in FIG. 4 can be received through rear entry aperture 100. Attachment-slots 101 are provided for mounting wall bracket 20 over such recessed junction boxes.

Wall bracket 20 is provided with a number of entry-sites 102 in addition to rear entry aperture 100. Top and side entry-sites 104, 106 are preferably knockouts for use as needed. Housing cover 18 has side cover-sites or knockouts 108 aligned with the corresponding entry-site on wall bracket 20 for use as needed. Slotted aperture 110 along top end 66 of housing cover 18 is a top cover-site and is aligned with top entry-site 104 on wall bracket 20. Top knockout 112 along upper edge 50 of support panel 14 is likewise used only when needed to insert electrical conduit 98 through slotted aperture 110 and top entry-site 104 into wall bracket 20.

Housing cover 18 is provided with lateral slots 113 to receive fasteners to align and attach housing cover 18 to wall bracket 20. First and second gaskets 114, 116 are mounted on front surface 54 and rear surface 118 of housing cover 18. Gaskets 114, 116 are preferably made from neoprene and served to create a water-tight seal around electrical wiring within apparatus 10. A gasket of similar material (not shown) is also mounted on the rear wall of wall bracket 20.

In the open position as illustrated in FIG. 4, electrical wiring 121 for the electrical components and lamp of fixture 12 are received through wiring aperture 24 of support panel 14. Fixture 12, being rigidly mounted upon support panel 14, stays in place and out of the way, elevated above the work space where electrical leads 99 serving as the source of power for fixture 12 and electrical wiring 121 are present. Both of the installer's hands are therefore free to safely make the necessary connections between electrical wiring 121 and electrical leads 99.

After the connections are completed, support panel 14 with fixture 12 can easily and quickly be slid over toward first front-wall portion 60 to allow support panel 14 to pivot completely downward into the closed position. In that position, locking fastener 120 on housing cover 16 is received by locking slot 122 in lower end 52 of support panel 14. By screwing down locking fastener 120, support panel 14 is secured to housing cover 16, giving apparatus 10 a pleasing and integrated appearance.

Although the invention has been described in conjunction with specific embodiments thereof, it is evident that many alterations, modification and variations will be apparent to those skilled in the art. Accordingly, it is intended to embrace all such alternatives, modifications and variations that fall within the spirit and broad scope of the appended claims.

The invention claimed is:

1. An apparatus for mounting a lighting fixture comprising:

a mount housing having a top end, at least one pivot portion positioned at the top end, the pivot portion including a rail, a tab-slot and a tab-rest, the tab-slot and tab-rest being adjacent to the rail, and two front-wall portions defining a support-panel cavity; and a support panel configured to allow the lighting fixture to be mounted thereto, the support panel having an upper end and at least one hook portion positioned at the upper end, the hook portion including a hook member and a tab-stand adjacent to the hook member and being slidably and pivotally engaged with respect to the pivot portion, whereby the support panel is free to move between an elevated and stationary open position about the mount housing wherein the open position is maintained by the tab-stand resting upon the tab-rest and a closed position wherein the tab-stand is received within the tab-slot and the support panel is fittingly received within the support-panel cavity whereby the front-wall portions together with the support panel complete a front-wall of the apparatus.

2. The apparatus of claim 1 wherein the hook portion is detachably engaged with respect to the pivot portion.

3. The apparatus of claim 2 wherein the mount housing has two pivot portions and the support panel has two corresponding hook portions.

4. The apparatus of claim 2 wherein the pivot portion includes a tab-stop positioned between the tab-slot and the tab-rest, the tab-stop being adjacent to the rail and projecting outward from the mount housing.

5. The apparatus of claim 1 wherein the mount housing has at least one entry-site, the entry-site being configured to receive an electrical conduit therethrough into the apparatus.

6. The apparatus of claim 5 wherein the mount housing comprises a wall bracket and a housing cover removably secured to the wall bracket.

7. The apparatus of claim 6 wherein the wall bracket has attachment-slots, whereby the mount housing can be secured to a junction box.

8. An apparatus for mounting a lighting fixture comprising:

a wall bracket having at least one entry-site adapted to receive an electrical conduit;

a housing cover removably secured to the wall bracket and having a cover-site, the cover-site being aligned with the entry-site, and two front-wall portions defining a support-panel cavity; and a support panel configured to be secured with respect to the lighting fixture, the support panel slidably and pivotally engaged with respect to the housing cover, the support panel being free to raise and lower the lighting fixture between an elevated and stationary open position about the housing cover and a closed position, the support-panel being sized to fittingly receive the support panel in the closed position, whereby the front-wall portions together with the support panel complete a front-wall of the apparatus.

9. The apparatus of claim 8 wherein the housing cover has at least one pivot portion, the pivot portion including a rail, a tab-slot and a tab-rest, the tab-slot and tab-rest being adjacent to the rail; the support panel has at least one hook portion, the hook portion being rigidly secured to the support panel and including a hook member and a tab-stand adjacent to the hook member, whereby the hook member is slidably and pivotally engaged to the rail; the tab-stand is supported upon the tab-rest in the open position whereby the support panel is elevated; and the tab-stand is received within the tab-slot in the closed position.

10. The apparatus of claim 9 wherein the hook member is detachably engaged with respect to the rail.

11. The apparatus of claim 10 wherein the wall bracket has attachment-slots, the attachment-slots being configured to secure the apparatus to a junction box.

12. A method for mounting a lighting fixture to a selected surface comprising:

providing a mounting apparatus having a mount housing with at least one pivot portion and two front-wall portions, the front-wall portions defining a support-panel cavity, and a support panel with at least one hook portion, the hook portion being slidably and pivotally engaged to the pivot portion such that the support panel is free to move between an elevated and stationary open position and a closed position wherein the support panel is fittingly received within the support-panel cavity such that the front-wall portions together with the support panel complete a front-wall of the mounting apparatus;

attaching the mount housing to the selected surface at a desired position;

inserting electrical leads into the mount housing;

securing the lighting fixture to the support panel;

moving the support panel to the open position to elevate the lighting fixture about the mount housing;

connecting the electrical leads to electrical wiring from the lighting fixture with the support panel in the open position; and moving the support panel to lower the lighting fixture into the closed position.

13. The method of claim 12 wherein the support panel is detachably engaged to the mount housing and further comprising the step of detaching the support panel from the mount housing and the step of attaching the support panel to the mount housing following the securing step.

14. The method of claim 12 wherein the mount housing comprises a wall bracket and a housing cover removably secured to the wall bracket.

15. The method of claim 14 wherein the mount housing has top, rear and side entry-sites sized to receive an electrical conduit.

16. The method of claim 15 wherein the desired position is adjacent to a junction box.

17. The method of claim 12 wherein the mount housing includes a tab-stop projecting outward from a front surface at a top end of the mount housing and wherein moving the support panel from the open position to the closed position requires pivoting the support panel upward and sliding the support panel over the tab-stop.

18. The method of claim 17 wherein the support panel has an upper end and includes a hook member rigidly mounted at the upper end and the mount housing includes a rigidly mounted rail at the top end, the hook member being slidably and pivotally engaged to the rail.

19. The method of claim 18 wherein the support panel includes a tab-stand at the upper end and the mount housing includes a tab-slot and a tab-rest, the tab-stop being positioned therebetween, wherein moving the support panel to the open position includes sliding the support panel along the rail to position the tab-stand over the tab-rest and pivoting the support panel downward to rest the tab-stand upon the tab-rest, and wherein moving the support panel to the closed position includes sliding the support panel along the rail to position the tab-stand over the tab-slot and pivoting the support panel downward to insert the tab-stand into the tab-slot.

20. An apparatus for mounting a lighting fixture comprising:

a mount housing having a top end, at least one pivot portion positioned adjacent to the top end, and two front-wall portions, the front-wall portions defining a support-panel cavity and the pivot portion being positioned on a front surface of the support-panel cavity; and a support panel configured to be secured with respect to the lighting fixture, the support panel having an upper end and at least one hook portion positioned adjacent to the upper end, the hook portion being slidably and pivotally engaged with respect to the pivot portion, whereby the support panel is free to raise and lower the lighting fixture between an elevated and stationary open position about the mount housing and a closed position, the support-panel being sized to fittingly receive the support panel in the closed position, whereby the front-wall portions together with the support panel complete a front-wall of the apparatus.

21. The apparatus of claim 20 wherein the pivot portion is rigidly mounted to the mount housing and includes a rail, a tab-slot and a tab-rest, the tab-slot and tab-rest being adjacent to the rail, and the hook portion is rigidly mounted to the support panel and includes a hook member and a tab-stand adjacent to the hook member.

22. The apparatus of claim 20 wherein the support panel has two hook portions, each of the hook portions being positioned adjacent to the upper end and including a hook member and a tab-stand adjacent to the hook member, the tab-stand projecting outward from a rear surface of the support panel, and the mount housing has two corresponding pivot portions, each of the pivot portions being positioned adjacent to the top end and including a rail, a tab-slot sized to receive the corresponding tab-stand when the support panel is in a closed position, and a tab-rest sized to support the corresponding tab-stand when the support panel is in the elevated open position, whereby each hook member is slidably and pivotally engaged to the corresponding rail.

23. The apparatus of claim 22 wherein the mount housing has a front surface and each pivot portion further includes a receptacle space, each receptacle space being defined by the front surface and sized to receive the corresponding hook member in the closed position.

24. The apparatus of claim 23 wherein each pivot portion further includes a tab-stop positioned between the tab-slot and the tab-rest, the tab-stop projecting outward from the front surface.

25. The apparatus of claim 24 wherein the tab-stands are spaced apart by a distance and both the tab-slots and the tab-rests are spaced apart by a substantially equal distance.

26. The apparatus of claim 25 wherein the support panel has an upper edge and a notch in the upper edge whereby, in the open position, the tab-stops limit inadvertent lateral movement of the support panel along the rails towards the first front-wall portion and the notch limits inadvertent lateral movement of the support panel along the rails towards the second front-wall portion.

* * * * *